United States Patent [19]

Schnäbele et al.

[11] 4,296,894

[45] Oct. 27, 1981

[54] DRONE-TYPE MISSILE

[75] Inventors: Werner Schnäbele, Wolfratshausen; Jack Buckley, Albaching; Ulrich Rieger, Feldkirchen-Westerham, all of Fed. Rep. of Germany

[73] Assignee: Messerschmitt-Bölkow-Blohm GmbH, Munich, Fed. Rep. of Germany

[21] Appl. No.: 14,720

[22] Filed: Feb. 23, 1979 (Under 37 CFR 1.47)

[30] Foreign Application Priority Data

Feb. 8, 1979 [DE] Fed. Rep. of Germany ..... 2904749

[51] Int. Cl.[3] ..... F42B 13/32; F42B 15/16

[52] U.S. Cl. ..... 244/3.27; 244/3.1

[58] Field of Search ..... 244/3.27, 3.28, 3.29, 244/3.1

[56] References Cited

U.S. PATENT DOCUMENTS

| | | | |
|---|---|---|---|
| 3,098,445 | 7/1963 | Jackson | 244/3.27 |
| 3,769,876 | 11/1973 | Haas et al. | 89/1.8 |
| 3,921,937 | 6/1973 | Voss et al. | 244/3.27 |
| 4,004,487 | 1/1977 | Eichweber | 244/3.27 |

FOREIGN PATENT DOCUMENTS

| | | | |
|---|---|---|---|
| 7603512 | 4/1975 | Netherlands | 244/3.28 |

*Primary Examiner*—Harold Tudor

*Attorney, Agent, or Firm*—Toren, McGeady & Stanger

[57] ABSTRACT

The invention relates to a drone-type missile for combatting ground targets from the ground, particularly for the use against targets which emit electromagnetic rays, such as radar stations; with built-in target-seeking head, guidance system, self-propulsion and take-off assist, preferably a booster rocket.

8 Claims, 3 Drawing Figures

Fig. 1
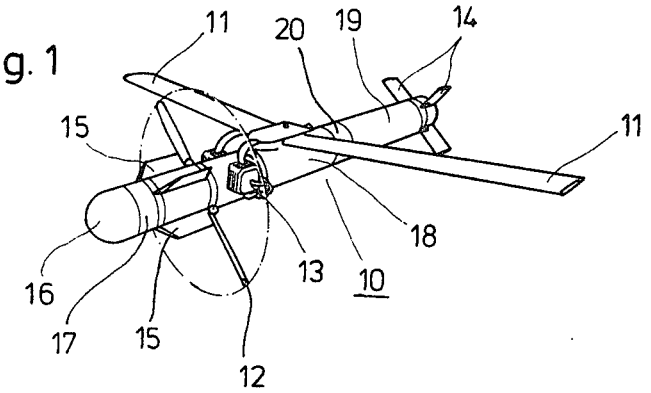
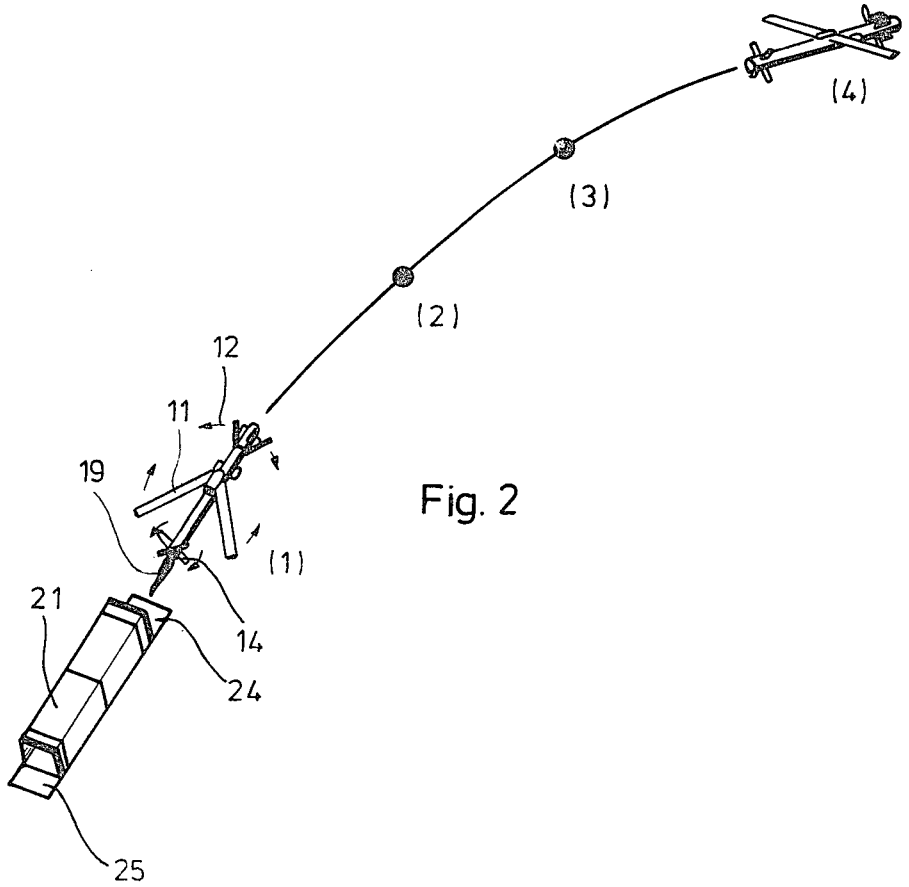
Fig. 2

DRONE-TYPE MISSILE

The invention relates to a drone-type missile for combatting ground targets from the ground, particularly for the use against targets which emit electromagnetic rays, such as radar stations; with built-in target-seeking head, guidance system, self-propulsion and take-off assist, preferably a booster rocket.

Missiles of the above-mentioned type are known. Originally used only for optical or optoelectronic enemy reconnaissance, the missiles, known as drones, are used in all areas of military air activity, for example, for eliminating enemy ground targets.

They are pilotless missiles which are usually launched from mobile launching ramps and approach a target either with a stored program or with remote guidance. Hydraulic catapults or booster rockets are used as take-off assists. Subsequently, an on-board drive starts to function, for example, a jet engine or also a conventional piston engine which drives a propeller. After the climbing flight, usually the stage of seeking begins from which, after recognizing a target, for example, a radar position of the enemy, the missile dives toward the target. The missile has a target-seeking head which, depending on the type of use, responds to certain targets. Apart from passive or active radar or infrared target-seeking heads, cameras are used which can transmit their picture to a remote operator who carries out the final guidance.

Since these types of missiles must perform significant stages of the mission in aerodynamic flight, for example, the climbing flight, the cruise flight, the seeking flight, wings must be provided for obtaining a lift. For this purpose, the use of delta wings has become known, see "Internationale Wehrrevue" 5/1978, page 701, wherein a pusher-type propulsion is provided on the top.

Other configurations have been proposed in "Aviation Week & Space Technology", May 17, 1976, pages 58 ff. In the latter, various arrangements of wings are shown as they are conventionally used in aircraft.

The known missiles of this type have various disadvantages. Due to the fact that they are relatively bulky, for example, because of the rigid wings, their manipulation is complicated. Accordingly, the assembly is alternatively carried out immediately prior to the mission. However, this increases the time and the personnel required for the assembly. In addition, the use of several drones without additional requirements in material is only possible successively in respect to time. Also it has not been possible heretofore to launch drones with different missions within a very short time.

It is the task of the invention to provide a missile of the above-mentioned type which requires very little space during the storage, transport, and launching stages and allows an arrangement in groups of a plurality of missiles, so that several missiles can be launched simultaneously or successively without any additional measures and can fulfill their individual missions, and which provides good flight performances in all stages of flight.

This task is solved thereby that the missile which is equipped with electronics which require individual mission data before the mission can be accommodated in a container for storage, for transport and for launching and is equipped with wings, tail assembly and propeller which, for this purpose, can be folded, preferably in the longitudinal direction of the missile, and automatically unfold after launching, and that the wings and the propeller can be dropped automatically at a predeterminable point in time after the launching.

Additional advantageous embodiments are found in the subclaims.

The realized missile can be palletized in a group of, for example, 60 containers and can be transported by means of any means of transportation. Basically, only one man is required for operating the launching; the requirements for the training of this man are not very high.

Due to the fact that the outwardly projecting components can be folded, a compact unit is created which requires only little space for storage, transport and launching. The missile can be assembled in its container completely ready for the mission already in the depot since merely the critical parts, inasfar as they are stored separately, must be inserted from behind in the missile at the end of the storage stage.

The invention is explained in more detail with the aid of the figures. In the drawing:

FIG. 1 shows a missile in the cruise flight configuration with unfolded components;

FIG. 2 shows the first stage of the flight sequence;

Figure 3:
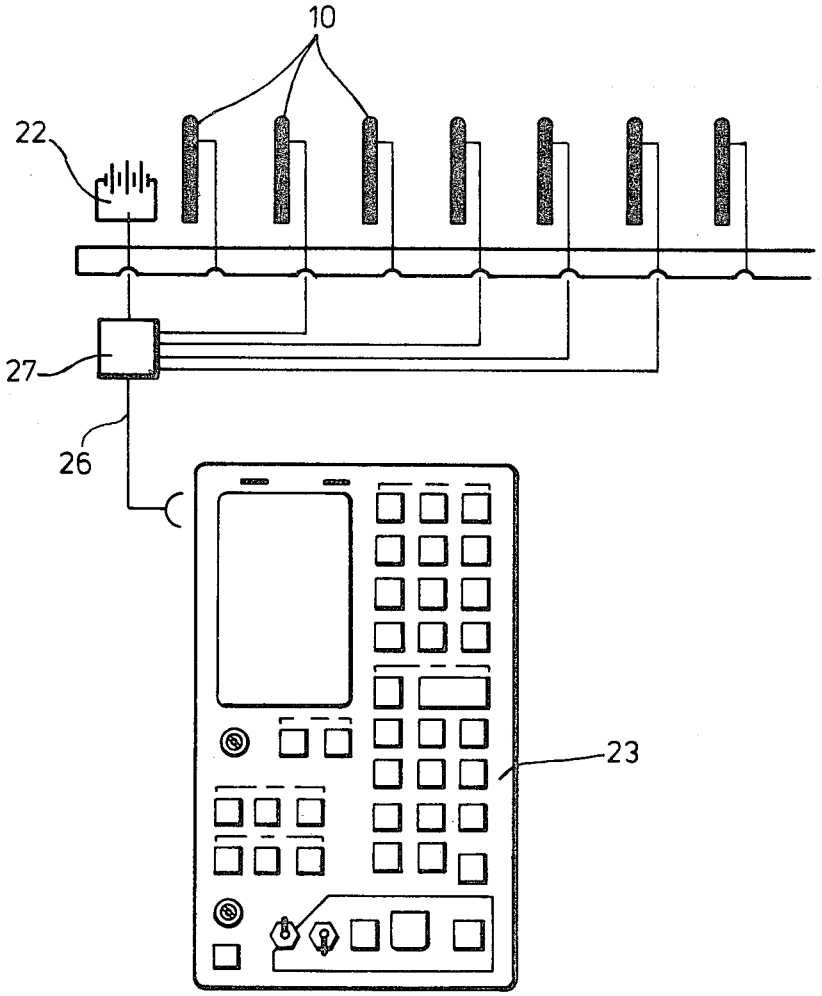
FIG. 3 shows a group of missiles.

According to FIG. 1, the missile 10 has wings 11, a propeller 12 with piston engine 13, tail assembly 14 and stabilizing fins 15. A target-seeking head 16 is followed by the electronics 17 including a navigating unit. In the rearward portions of the missile 10 there are provided, without detailed illustration, a tank 18 for the piston engine 13 and a booster rocket 19 and a warhead 20.

According to FIG. 2, the missile 10 is at first in a container 21 which is inclined by an appropriate launching angle. The container 21 serves for the storage, the transport, as well as the launching of the missile 10. Together with the missile 10, the container forms a complete, self-sufficient mission unit which, for launching, is merely connected to a battery 22 and a programming device 23 (see FIG. 3). The container 21 has front and rear covers 24, 25 which open during launching. After the storing stage, the warhead 20 and the booster rockets 19 are inserted in the missile 10 through the rear cover 25. The missile 10 is stored in the container 21 under protective gas and with moisture absorption. The container 21 with the dimensions of, for example, $L \times W \times H = 2.3\ m \times 0.5\ m \times 0.3\ m$ can be stacked in any chosen fashion and can be expanded to groups of any desired size. For example, a group of 60 containers can be accommodated on a 6 t vehicle.

For launching, by means of the programming device 23 and through a cable 26, the individual mission data are fed into the electronics 17 of the missile 10 (FIG. 3). Such data are, for example, flight directions, flight speeds, flight heights, flight courses, holding points, types of targets, periods for seeking and trajectory of attack, etc. The programming device can also be used for testing the function of the missile.

After the launching preparations have been concluded, the missile is checked and programmed in launching position in the open container. At this point in time, the piston engine 13 runs with uncoupled propeller 12. The booster rocket 19 is ignited (time 1) and the connections to the container are disconnected. After leaving the container 21, the propeller 12, the wings 11 and the tail assembly 14 and possibly an antenna, not shown in detail, unfold (time 2). After about one second, the propellant cutoff of the rocket occurs (time 3). The elements 11, 12, 14 are now completely unfolded.

The propeller 12 which thus far has freely rotated in the air flow is coupled by means of an electromagnetic coupling (time 4); the missile 10 has now assumed its cruising flight configuration.

From now on, the missile follows the preprogrammed mission command, for example, swinging into the prescribed course during the climbing flight to the predetermined height.

The wings 11 may either be a continuous surface which rotates about the center, or two separate wings which rotate at the ends, as indicated in FIG. 2.

The drive for unfolding is effected through a worm gearing which ensures synchronized movement and locking in the extended position. Propeller 12 and tail assembly 14 can unfold supported by a spring, or due to centrifugal force with a locking mechanism.

For guiding the missile 10, known methods are used, for example, inertial navigation in the dead-reckoning method by means of compass and clock, supported by an omega navigating device, while the target-seeking head 16, supported by inertia sensors, serves for the orientation at the target.

The wings 11 and the propeller 12 are dropped at the beginning of the attacking stage, so that there are insignificant trajectory interferences during the final approach. The warhead 20 is accommodated in the rear portion of the missile which results, among other things, in an optimum detonation height.

According to FIG. 3, a plurality of missiles are connected to the programming device 23 by means of cable 26. A change-over switch 27 responds to the selected missile. The battery 22 may be a normal vehicle battery whose capacity is fully sufficient. The data input may be carried out automatically by magnetic tape or also manually through a control panel, wherein automatic aids and controls serve to significantly relieve the programmer.

We claim:

1. A drone missile system, comprising:
a missile having a target-seeking head,
a guidance system,
a self-propulsion and take-off system,
electronic means for storing individual mission data prior to the mission,
a pair of wings,
a tail assembly, and
a propeller,
said missile having a shape defining a longitudinal direction,
said wings, as well as said tail assembly and said propeller being foldable in the longitudinal direction of the missile and automatically unfoldable transverse to the longitudinal direction of the missile,
said wings and said propeller being automatically detachable in flight after launching, and
a container for storing as well as transporting and launching the missile when the wings as well as said tail assembly and said propeller are folded in the longitudinal direction.

2. A drone missile system, comprising:
a missile having a target-seeking head,
a guidance system,
a self-propulsion and take-off system,
electronic means for storing individual mission data prior to the mission,
a pair of wings,
a tail assembly, and
a propeller,
said missile having a shape defining a longitudinal direction,
means for allowing folding of said wings as well as said tail assembly and said propeller in the longitudinal direction of the missile and for automatically unfolding them transverse to the longitudinal direction of the missile,
means for automatically detaching said wings and said propeller in flight after launching, and
a container for storing as well as transporting and launching the missile when the wings as well as said tail assembly and said propeller are folded in the longitudinal direction.

3. A missile system as in claim 1 or claim 2, wherein said missile includes means for receiving a booster rocket and a warhead, wherein said container includes a cover located behind the missile through which said booster rocket and said warhead can be mounted on the missile.

4. A missile system as in claim 1 or claim 2, wherein said container surrounds the missile with the wings as well as said tail assembly and said propeller being folded.

5. A missile system as in claim 4 or claim 2, wherein said missile includes a piston engine for driving said propeller, said piston engine being startable within the container while uncoupled from the propeller, and electromagnetic couplings for automatically coupling said propeller to said piston engine.

6. A missile system as in claim 4 or claim 2, further comprising a programming device connectable to said electronic means for entering mission data into said electronic means.

7. A missile system as in claim 6 or claim 2, wherein said programming device includes means for entering preprogrammed mission data.

8. A missile system as in claim 6 or claim 2, wherein said programming means includes a data entry board for manually entering data.

* * * * *